US009863441B2

(12) United States Patent
Eidmohammadi et al.

(10) Patent No.: US 9,863,441 B2
(45) Date of Patent: Jan. 9, 2018

(54) CLEANING DEVICE GENERATING TWO SUCTION FLOWS

(71) Applicant: Vorwerk & Co. Interholding GmbH, Wuppertal (DE)

(72) Inventors: Nazli Eidmohammadi, Goeteborg (SE); Alexander Siegfanz, Wuppertal (DE); Christian Stehl, Wuppertal (DE); Sabrina Hoffmann, Solingen (DE); Miron Sernecki, Hagen (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 294 days.

(21) Appl. No.: 14/686,940

(22) Filed: Apr. 15, 2015

(65) Prior Publication Data

US 2015/0300376 A1 Oct. 22, 2015

(30) Foreign Application Priority Data

Apr. 16, 2014 (DE) ..... 10 2014 105 459

(51) Int. Cl.

| | |
|---|---|
| ***F04F 5/02*** | (2006.01) |
| ***A47L 9/10*** | (2006.01) |
| ***A47L 7/00*** | (2006.01) |
| ***A47L 5/22*** | (2006.01) |
| ***A47L 9/00*** | (2006.01) |
| ***A47L 9/14*** | (2006.01) |
| ***A47L 5/18*** | (2006.01) |

(52) U.S. Cl.

CPC ..... *F04F 5/02* (2013.01); *A47L 5/18* (2013.01); *A47L 5/22* (2013.01); *A47L 7/0004* (2013.01); *A47L 7/0009* (2013.01); *A47L 7/0023* (2013.01); *A47L 9/00* (2013.01); *A47L 9/1409* (2013.01)

(58) Field of Classification Search

CPC . A47L 5/18; A47L 5/22; A47L 7/0004; A47L 7/0009; A47L 7/0023; A47L 9/00; A47L 9/1409; F04F 5/02

See application file for complete search history.

(56) References Cited

U.S. PATENT DOCUMENTS 2,863,525 A * 12/1958 Lucian ..... A47L 5/18 15/409
3,778,864 A * 12/1973 Scherer ..... A47L 5/18 15/339

(Continued)

FOREIGN PATENT DOCUMENTS

DE 102011121196 A1 * 6/2013 ..... E01H 1/001

OTHER PUBLICATIONS

DE 102011121196 A1—Jun. 2013—English Machine Translation.*

*Primary Examiner* — Marc Carlson
(74) *Attorney, Agent, or Firm* — Collard & Roe, P.C.

(57) ABSTRACT

A cleaning device includes an air flow generator for generating an air flow, which encompasses a first suction flow through a first suction line, which is arranged in flow direction of the air flow upstream of the air flow generator and which leads into a first collecting container, and a pressure flow in a pressure line, which is arranged in flow direction of the air flow downstream from the air flow generator. Using a Venturi nozzle, the air flow generates a second suction flow, which is separated from the first suction flow, through a second suction line, which leads into a second collecting container.

8 Claims, 2 Drawing Sheets

(56) References Cited

U.S. PATENT DOCUMENTS 5,142,730 A * 9/1992 Braks ..... A47L 7/0028 15/314
6,049,941 A * 4/2000 Vollenweider, II ..... A47L 5/18 15/327.5
6,826,799 B2 * 12/2004 Smith ..... A47L 5/18 15/353
7,203,994 B2 * 4/2007 Smith ..... A47L 5/18 15/353
7,299,522 B1 * 11/2007 Smith ..... A47L 5/18 15/353
7,527,665 B2 * 5/2009 Etter ..... B01D 46/0004 55/467
7,676,965 B1 * 3/2010 Nathenson ..... E02F 3/9206 37/317
2006/0032014 A1 * 2/2006 Smith ..... A47L 5/18 15/409
2006/0048489 A1 * 3/2006 Etter ..... B01D 46/0004 55/385.1
2010/0192980 A1 * 8/2010 Turner ..... A47L 5/365 134/21
2013/0232723 A1 * 9/2013 Catalfamo ..... A47L 5/18 15/347

* cited by examiner

CLEANING DEVICE GENERATING TWO SUCTION FLOWS

CROSS REFERENCE TO RELATED APPLICATIONS

Applicant claims priority under 35 U.S.C. §119 of German Application No. 10 2014 105 459.8 filed Apr. 16, 2014, the disclosure of which is incorporated by reference.

BACKGROUND OF THE INVENTION

1. Field of the Invention

The invention relates to a cleaning device comprising an air flow generator for generating an air flow, which can generate a first suction flow in a first suction line, which is arranged in flow direction of the air flow upstream of the air flow generator and which leads into a first collecting container, and a pressure flow in a pressure line, which is arranged in flow direction of the air flow downstream from the air flow generator.

2. Description of the Related Art

Such cleaning devices are known as dry and wet vacuum cleaners, as hand-held devices or as self-propelled robots. An air flow is generated by means of a mechanical air flow generator, which, as a rule, is embodied by a blower wheel, which is driven by an electric motor. A suction flow forms upstream of the air flow generator, solid or liquid particles can be absorbed from a surface through a suction line and can be collected in a first collecting container. A pressure flow, which, for the most part, leaves the device from an outlet device, is formed downstream from the air flow generator.

SUMMARY OF THE INVENTION

The invention is based on the task of further developing the above-described cleaning device so as to be advantageous in its use and to expand the use spectrum of the device in particular by means of simple means.

To solve the task, it is initially and substantially proposed that a second suction flow can be generated in addition to the first suction flow. While the first suction flow flows through a first suction line, which leads into a first collecting container when the air flow generator is in operation, the second suction flow flows through a second suction line, which leads into a second collecting container.

Provision is made for means, in particular hydrodynamic means, by means of which the air flow of the air flow generator can generate the second suction flow. This preferably takes place in that the kinetic energy of the second suction flow can be gained from the kinetic energy of the pressure flow. The kinetic energy of the second suction flow can be extracted from the kinetic energy of the pressure flow. This takes place in a more preferable manner by means of a hydromechanical device, in particular a nozzle arrangement and particularly preferably a Venturi nozzle arrangement.

The pressure line and a suction channel lead into the nozzle arrangement, wherein the suction channel is in flow connection with a second suction line.

The air flow can be generated in the known manner by a mechanical air flow generator, for example by a blower wheel, which is driven by an electric motor. The pressure flow generated by the air flow generator escapes from a pressure outlet nozzle into a suction channel of a second cleaning aggregate, so that the pressure flow escapes in the direction of extension of the suction channel. The pulse of the pressure flow, which escapes from the pressure flow outlet opening, is transferred to the air within the suction channel surrounding the pressure flow outlet opening. The second suction flow is formed as a result of this pulse transfer.

According to the invention, a first suction flow, by means of which for example dry particles can be absorbed from a surface and can be conveyed into a collecting container, is thus generated by means of only one mechanical air flow generator. Kinetic energy is removed from the air flow, which is generated by the mechanical air flow generator, so as to generate a second suction flow therewith, which, for example, removes wet particles, in particular droplets, at a surface, so as to transport them into a collecting container, which is assigned to the second suction flow.

However, provision is also made for moisture to be absorbed by means of the first suction flow, which is generated directly by the air flow generator, and for dry particles to be collected by means of the second suction flow, which is generated by a nozzle arrangement.

With regard to the transport of the wet or liquid particles using suction nozzles, suction hoses or the like, known and proven technologies can be accessed. The filtering of the liquid or solid particles from the first or the second suction flow also takes place by means of the known devices, for example dust bags, dust filters or by means of the force of gravity or a centrifugal force.

The cleaning device according to the invention is particularly preferably embodied as self-propelled suction robot. It can thereby be a floor wiper, which encompasses a clean water tank, in the case of which the water stored therein is used to wet a surface, which is to be cleaned. The moisture can then be absorbed together with dirt particles, which are dissolved in a moisture film, by the first or the second suction flow. A dry cleaning takes place by means of the respective other suction flow. A classic Venturi nozzle arrangement can be used to generate the second suction flow, in the case of which the hydromechanical principle is used that, in response to an acceleration of a gas flow, the static pressure is reduced and that a suction flow can be generated through this. In the case of such a Venturi nozzle, the air flow generated by the air flow generator flows through a nozzle section, in which the cross section of the pressure flow channel is reduced. Transversely to the air flow, a suction channel leads into a nozzle section comprising a minimum cross section. The nozzle cross section opens in flow direction downstream from the suction channel, so that the flow speed of the air flow, which is at a maximum in the area of the port of the suction channel, can be reduced.

The invention can also be described to the effect that it pertains to a cleaning device comprising an air flow generator for generating an air flow, which encompasses a first suction flow through a first suction line, which is arranged in flow direction of the air flow upstream of the air flow generator, and a pressure line and which leads into a first collecting container, and a pressure flow in a pressure line, which is arranged in flow direction of the air flow downstream from the air flow generator. For the solution, provision can be made that provision is made for means, by means of which the air flow generates a second suction flow, which is separated from the first suction flow, through a second suction line, which leads into a second collecting container.

It is preferred that the kinetic energy of the second suction flow is gained from the kinetic energy of the pressure flow.

Provision can be made for the cleaning device to encompass an opening, which leads into a cross section-reducing area of the nozzle arrangement transversely to the flow direction of the pressure flow, of a suction channel, which guides the second suction flow.

BRIEF DESCRIPTION OF THE DRAWINGS

Exemplary embodiments of the invention will be explained below by means of enclosed drawings. In the figures.

DETAILED DESCRIPTION OF PREFERRED EMBODIMENTS

Figure 1:
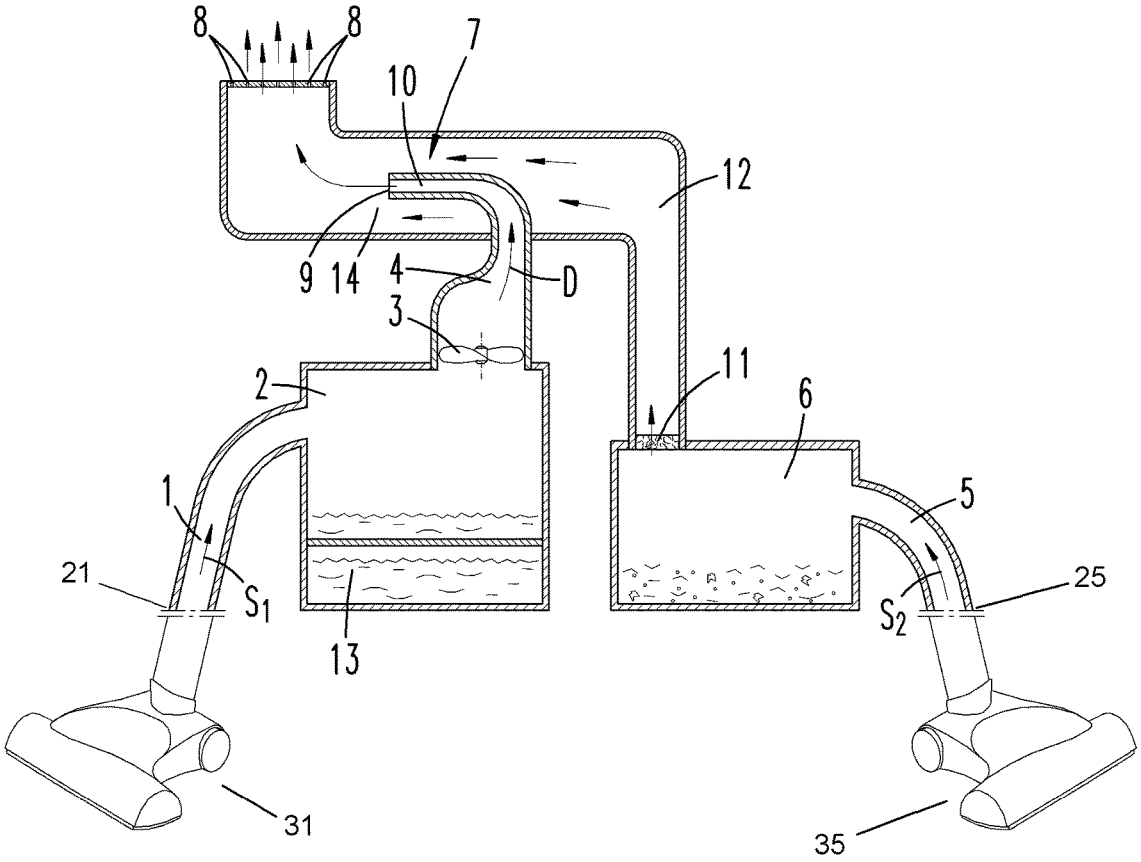
FIG. 1 shows, schematically, the design of a first exemplary embodiment.

FIG. 1 substantially shows elements of a cleaning unit, for example of a self-propelled cleaning device in the form of a suction robot or of a device, which can be displaced by hand. On its free end 21, a first suction line 1 has a nozzle arrangement 31 for collecting moisture from a surface. The first suction line 1 leads into a first collecting container 2, in which the moisture can be separated from the air flow; for example, the droplets collect on the bottom of the first collecting container 2. Upstream of the air flow generator 3, a mechanical air flow generator 3 in the form of an impeller, which is rotationally driven by an electric motor, generates a suction flow $S_1$, by means of which said liquid particles are conveyed through the first suction line 1.

A pressure line 4, through which the air flow generated by the air flow generator 3 is conveyed as pressure flow D into a nozzle channel 10, is located downstream from the air flow generator 3 in flow direction of the air flow. The nozzle channel 10 ends in a pressure flow outlet opening 9, through which the pressure flow D enters into a mixing zone 14 of a suction channel 12. The nozzle channel 10 extends parallel to the direction of extension of the suction channel 12 and, in the exemplary embodiment, in the center of the cross section thereof. The air, which escapes from the pressure flow outlet opening 9, partially transfers its pulse in the mixing zone 14 to the air therein, so that a second suction flow, which is directed parallel to the air pressure flow, which escapes form the pressure flow outlet opening 9, is formed in the suction channel 12.

The suction channel 12 is connected to a second collecting container 6, into which a second suction line 5 leads. The free end 25 of the second suction line 5 is provided with a nozzle arrangement 35, so as to absorb solid particles from a surface, which is to be cleaned. The second suction flow $S_2$ flows through the second suction line 5.

Dust filters, dust bags or the like can be arranged within the second collecting container 6, so as to filter the particles located in the second suction flow $S_2$ out of the air flow. For the sake of clarity, only one dust filter 11 is illustrated in FIG. 1 at the inlet opening of the suction channel 12.

The air flow generated by the air flow generator 3 mixes with the second suction flow $S_2$ in the mixing zone 14. All of the outlet air flows out of the cleaning device through an outlet opening 8. A fresh water tank is identified with reference numeral 13; the fresh water stored therein can be used for a wiper device and can be absorbed via the suction line 1.

Figure 2:
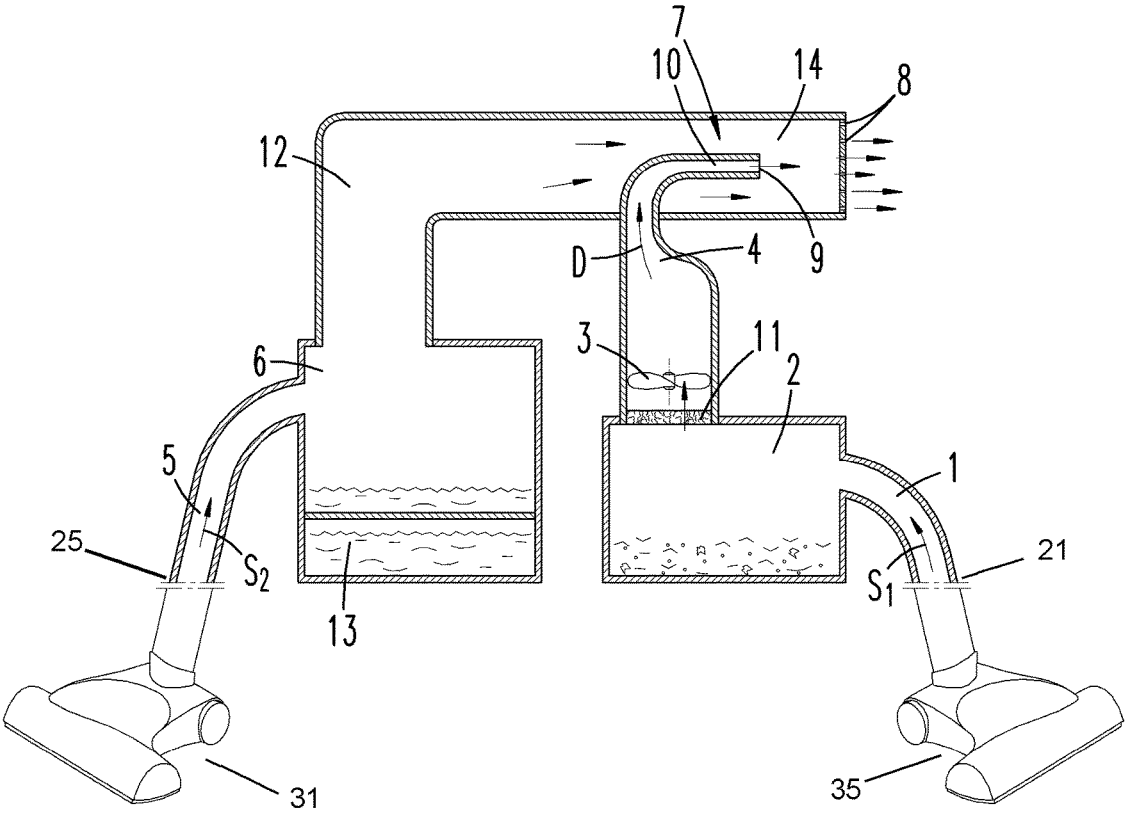
FIG. 2 shows, schematically, the design of a second exemplary embodiment

The device, which is also shown only schematically in FIG. 2, also shows the technical elements, which are relevant for the invention, of a cleaning device, for example of a self-propelled robot or manually movable device. A second suction flow $S_2$ is also generated here from the pressure flow D, which is generated by an air flow generator 3, by means of a nozzle arrangement 7. Here, the pressure flow D is also guided into a mixing zone 14 of the suction channel 12 by means of a nozzle channel 10, which runs parallel to a suction channel 12, namely in the center of the cross section thereof, so that a second suction flow $S_2$ is generated upstream of the mixing zone 14. In contrast to the first exemplary embodiment, the first suction line 1, through which the first suction flow $S_1$ flows, which is generated directly by the air flow generator 3, is connected here to a collecting container 2, in which dry particles are separated. The first suction line 1 has the free end 21 and a nozzle arrangement 35 so as to absorb solid particles from a surface.

In this exemplary embodiment, the second suction line 5, through which the second suction flow $S_2$ flows, is connected to a collecting container 6, in which liquid can collect. The second suction line 5 has a free end 25 and a nozzle arrangement 31 for collecting moisture from a surface. Provision is also made here for a fresh water tank 13, so that the device can operate as wiping device.

Figure 3:
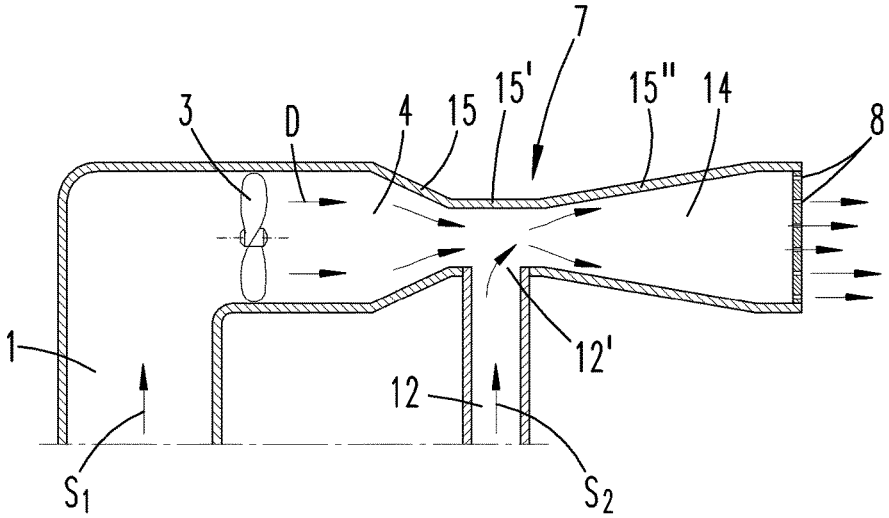
FIG. 3 shows, schematically, the design of a classical Venturi nozzle, which can be used in one of the exemplary embodiments illustrated in FIGS. 1 and 2.

FIG. 3 shows, schematically, the design of a classical Venturi nozzle, which, in the exemplary embodiments according to FIGS. 1 and 2, can be used instead of the nozzle arrangement illustrated therein. A pressure flow D flows in a pressure line 4, which is located downstream from the mechanical air flow generator 3. As a result of a conical wall of the nozzle section 15, the cross sectional surface of the pressure line 4 decreases in a first nozzle section 15 of the nozzle arrangement 7, so that the speed of the pressure flow D is increased. The pressure flow D passes through a second nozzle section 15' comprising a constant cross sectional surface at this increased speed. A port opening 12', which extends transversely to the flow direction of the air pressure D, of a suction channel 12, in which a second suction flow S2 is formed, is located in this second nozzle section 15'. A third nozzle section 15", which also has conical nozzle channel walls, follows the second nozzle section 15', so that the cross section of the third nozzle section 15" increases continuously in flow direction, which leads to a continuous decrease of the flow speed. The third nozzle section 15" forms a mixing zone 14, to which an outlet opening 8 connects.

The above explanations serve to explain all of the inventions, which are encompassed by the application, which in each case further develop the state of the art independently at least by means of the following feature combinations, namely:

A cleaning device, which is characterized in that provision is made for means, by means of which the air flow generates a second suction flow $S_2$, which is separated from the first suction flow $S_1$, through a second suction line 5, which leads into a second collecting container 6.

A cleaning device, which is characterized in that the kinetic energy of the second suction flow $S_2$ is gained from the kinetic energy of the pressure flow D.

A cleaning device, which is characterized in that the means encompass a nozzle arrangement, wherein the pressure line 4 and a suction channel 12, which guides the second suction flow $S_2$, lead into the nozzle arrangement 7, in particular a Venturi nozzle arrangement.

A cleaning device, which is characterized in that a pressure flow outlet nozzle 9, through which the pressure flow D escapes in the direction of extension of the suction channel 12, leads into the suction channel 12, which guides the second suction flow $S_2$.

A cleaning device, which is characterized by an opening 12', which leads into a cross section-reducing area 15' of the nozzle arrangement 7 transversely to the flow direction of the pressure flow D, of a suction channel 12, which guides the second suction flow $S_2$.

A cleaning device, which is characterized in that one of the first and second collecting containers 2, 6 is provided for separating dry particles from the first or second suction flow $S_1$, $S_2$, and the respective other collecting container 6, 2 is provided for separating droplets from the respective other suction flow $S_2$, $S_1$.

A cleaning device, which is characterized in that the cleaning device is a self-propelled suction robot.

| REFERENCE LIST | |
|---|---|
| 1 | first suction line |
| 2 | first collecting container |
| 3 | air flow generator |
| 4 | pressure line |
| 5 | second suction line |
| 6 | second collecting container |
| 7 | nozzle arrangement |
| 8 | outlet opening |
| 9 | pressure flow outlet opening |
| 10 | nozzle channel |
| 11 | dust filter |
| 12 | suction channel |
| 12' | mouth opening |
| 13 | fresh water tank |
| 14 | mixing zone |
| 15 | first nozzle section |
| 15' | second nozzle section |
| 15" | third nozzle section |
| D | pressure flow |
| $S_1$ | first suction flow |
| $S_2$ | second suction flow |

What is claimed is:

1. A cleaning device comprising an air flow generator for generating an air flow, which can generate a first suction flow in a first suction line, which is arranged in a flow direction of the air flow upstream of the air flow generator and which leads into a first collecting container, and a pressure flow in a pressure line, which is arranged in the flow direction of the air flow downstream from the air flow generator, wherein the cleaning device has a first nozzle arrangement causing the air flow to generate a second suction flow, which is separated from the first suction flow, through a second suction line, which leads into a second collecting container, wherein the pressure line and a suction channel, which guides the second suction flow, lead into the first nozzle arrangement, wherein the first suction line and the second suction line each has a respective free end, wherein the free end of the first suction line or of the second suction line has a second nozzle arrangement for collecting moisture from a surface, and wherein the free end of the other of the first suction line and the second suction line has a third nozzle arrangement to absorb solid particles.

2. The cleaning device according to claim 1, wherein kinetic energy of the second suction flow can be gained from kinetic energy of the pressure flow.

3. The cleaning device according to claim 1, wherein the first nozzle arrangement comprises a Venturi nozzle arrangement.

4. The cleaning device according to claim 1, wherein a pressure flow outlet nozzle, through which the pressure flow escapes in the direction of extension of the suction channel, leads into the suction channel, which guides the second suction flow.

5. The cleaning device according to claim 1, wherein the pressure flow encompasses a flow direction and wherein provision is made for an opening, which leads into a cross section-reducing area of the first nozzle arrangement transversely to the flow direction of the pressure flow of the suction channel, which guides the second suction flow.

6. The cleaning device according to claim 1, wherein the cleaning device is a self-propelled suction robot.

7. A cleaning device comprising an air flow generator for generating an air flow, which can generate a first suction flow in a first suction line, which is arranged in a flow direction of the air flow upstream of the air flow generator and which leads into a first collecting container, and a pressure flow in a pressure line, which is arranged in the flow direction of the air flow downstream from the air flow generator, wherein the cleaning device has a first nozzle arrangement causing the air flow to generate a second suction flow, which is separated from the first suction flow, through a second suction line, which leads into a second collecting container, wherein the pressure line and a suction channel, which guides the second suction flow, lead into the first nozzle arrangement, and wherein one of the first and second collecting containers is provided for separating dry particles from the first or second suction flow, and the respective other collecting container is provided for separating droplets from the respective other suction flow.

8. The cleaning device according to claim 7, wherein the first suction line and the second suction line each has a respective free end, wherein the free end of the first suction line or of the second suction line has a second nozzle arrangement for collecting moisture from a surface, and wherein the free end of the other of the first suction line and the second suction line has a third nozzle arrangement to absorb solid particles.

* * * * *